US009914562B2

(12) United States Patent
Fox et al.

(10) Patent No.: US 9,914,562 B2
(45) Date of Patent: Mar. 13, 2018

(54) PRODUCE CONTAINER

(71) Applicant: Kenneth Fox Supply Company, McAllen, TX (US)

(72) Inventors: L. Keith Fox, McAllen, TX (US); Aaron Fox, McAllen, TX (US); Craig Fox, McAllen, TX (US)

(73) Assignee: Kenneth Fox Supply Company, McAllen, TX (US)

( * ) Notice: Subject to any disclaimer, the term of this patent is extended or adjusted under 35 U.S.C. 154(b) by 0 days.

(21) Appl. No.: 15/366,539

(22) Filed: Dec. 1, 2016

(65) Prior Publication Data

US 2017/0081083 A1 Mar. 23, 2017

Related U.S. Application Data

(63) Continuation of application No. 14/516,055, filed on Oct. 16, 2014, now Pat. No. 9,561,882.
(Continued)

(51) Int. Cl.
*B65D 30/04* (2006.01)
*B65D 30/06* (2006.01)
(Continued)

(52) U.S. Cl.
CPC ..... *B65D 29/04* (2013.01); *B65D 31/08* (2013.01); *B65D 31/10* (2013.01); *B65D 33/01* (2013.01);
(Continued)

(58) Field of Classification Search
CPC ..... B65D 31/08; B65D 31/10; B65D 85/345; B65D 29/04
See application file for complete search history.

(56) References Cited

U.S. PATENT DOCUMENTS 1,906,500 A 5/1933 Twitchell
2,085,365 A 6/1937 Israel
(Continued)

FOREIGN PATENT DOCUMENTS

EP 1181204 2/2002
EP 1210276 6/2002
EP 1371569 12/2003

OTHER PUBLICATIONS

International Searching Authority, "Notification of Transmittal of the International Search Report and the Written Opinion of the International Searching Authority," dated Feb. 13, 2015, in International application No. PCT/US2014/060889.

*Primary Examiner* — Derek Battisti
(74) *Attorney, Agent, or Firm* — Trop, Pruner & Hu, P.C.

(57) ABSTRACT

An embodiment includes a bag comprising mesh and film side walls and a reinforcing strip of film; wherein (a) the mesh side wall is sealed to opposing side edges of the film side wall; (b) the reinforcing strip of film is sealed to an upper portion of the mesh side wall and to the opposing side edges of the film side wall; (c) the film side wall has a bottom extension, which is monolithic with the film side wall, extending upwardly and sealed along a lateral extent of a bottom portion of the mesh side wall; (d) the film side wall is non-coplanar with a portion of the bottom extension; (e) another portion of the bottom extension is non-coplanar with the mesh side wall; and (f) a horizontal axis intersects the bottom portion of the film side wall and three portions of the bottom extension.

20 Claims, 11 Drawing Sheets

Related U.S. Application Data

(60) Provisional application No. 61/892,416, filed on Oct. 17, 2013, provisional application No. 61/925,180, filed on Jan. 8, 2014, provisional application No. 62/010,810, filed on Jun. 11, 2014.

(51) Int. Cl.

| | |
|---|---|
| ***B65D 30/18*** | (2006.01) |
| ***B65D 33/01*** | (2006.01) |
| ***B65D 33/16*** | (2006.01) |
| ***B65D 33/25*** | (2006.01) |
| ***B65D 30/20*** | (2006.01) |
| ***B65D 33/02*** | (2006.01) |
| ***B65D 33/08*** | (2006.01) |
| ***B65D 33/14*** | (2006.01) |

(52) U.S. Cl.

CPC ..... *B65D 33/02* (2013.01); *B65D 33/08* (2013.01); *B65D 33/14* (2013.01); *B65D 33/1625* (2013.01); *B65D 33/2508* (2013.01)

(56) References Cited

U.S. PATENT DOCUMENTS

| | | | | |
|---|---|---|---|---|
| 2,646,203 | A * | 7/1953 | Brady | B65D 33/01 383/102 |
| 3,257,915 | A | 6/1966 | Pierre | |
| 3,537,360 | A | 11/1970 | Farnam | |
| 4,403,637 | A | 9/1983 | Sabater | |
| 5,741,076 | A | 4/1998 | Cammack | |
| 6,024,489 | A | 2/2000 | Fox | |
| 6,030,120 | A | 2/2000 | Fox | |
| 6,190,044 | B1 * | 2/2001 | Fox | B65D 29/04 206/554 |
| 6,286,681 | B1 * | 9/2001 | Wilfong, Jr. | B65D 33/001 206/554 |
| 6,416,220 | B1 | 7/2002 | Fox | |
| 6,626,570 | B2 * | 9/2003 | Fox | B65D 29/04 383/117 |
| 6,866,620 | B2 | 3/2005 | Friedman | |
| 7,163,339 | B1 * | 1/2007 | Hefner | B31B 19/00 206/554 |
| 7,640,715 | B2 | 1/2010 | Hefner | |
| 7,837,388 | B1 | 11/2010 | Hefner | |
| 8,550,717 | B2 | 10/2013 | Hefner | |
| 2002/0186900 | A1 * | 12/2002 | Horne | B65D 75/008 383/104 |
| 2004/0013325 | A1 * | 1/2004 | Cook | B65D 31/08 383/104 |
| 2004/0032992 | A1 * | 2/2004 | Hershku | B65D 33/14 383/9 |
| 2010/0209022 | A1 * | 8/2010 | Gilmore | B65D 33/16 383/94 |
| 2011/0085749 | A1 | 4/2011 | Frei | |
| 2011/0211775 | A1 * | 9/2011 | Worthington | B65D 29/04 383/7 |
| 2014/0212068 | A1 * | 7/2014 | Yu | B65D 75/008 383/7 |

* cited by examiner

PRODUCE CONTAINER

This application is a continuation of U.S. patent application Ser. No. 14/516,055, filed Oct. 16, 2014 and entitled "Produce Container."

This application claims priority to U.S. Provisional Patent Application No. 61/892,416, filed on Oct. 17, 2013 and entitled "Produce Container."

This application claims priority to U.S. Provisional Patent Application No. 61/925,180 filed on Jan. 8, 2014 and entitled "Product Container."

This application claims priority to U.S. Provisional Patent Application No. 62/010,810 filed on Jun. 11, 2014 and entitled "Stand-Up Combo."

The content of each of the above applications is hereby incorporated by reference.

TECHNICAL FIELD

Embodiments of the invention are in the field of packaging and, in particular, food packaging.

BACKGROUND

Produce bags for automatic produce packing machines may include holes. Using the holes the bags can be suspended from wickets or pegs on an automatic packing machine. Such bags may include polyethylene film, or films made from various (different/alternative) resins with different properties.

Produce bags may include a synthetic resin open fabric mesh such as the bags described in U.S. Pat. No. 6,030,120, assigned to Kenneth Fox Supply Co. of McAllen, Tex. Such bags may include a synthetic resin fabric open mesh, such as the nonwoven fabric of cross-laminated synthetic resin fibers or strands known as Cross Laminated Airy Fabric® or (CLAF). This fabric is an open mesh material of cross-laminated warp and weft strands or fibers of synthetic resin. Produce bags may include other synthetic resin open mesh fabrics of slitted or extruded strands, or extruded filaments where the cross-directional components are bonded together by alternative processes that include, but not limited to, heat lamination, ultrasonic bonding, or adhesive bonding. Some of these open mesh structure fabrics include Meltac (Hagihara) and Otx (Oxtex Co., Ltd).

BRIEF DESCRIPTION OF THE DRAWINGS

Features and advantages of embodiments of the present invention will become apparent from the appended claims, the following detailed description of one or more example embodiments, and the corresponding figures. Where considered appropriate, reference labels have been repeated among the figures to indicate corresponding or analogous elements.

DETAILED DESCRIPTION

Drawings included herein may only show the structures useful to understand the illustrated embodiments. Additional structures known in the art may not have been included to maintain the clarity of the drawings. "An embodiment", "various embodiments" and the like indicate embodiment(s) so described may include particular features, structures, or characteristics, but not every embodiment necessarily includes the particular features, structures, or characteristics. Some embodiments may have some, all, or none of the features described for other embodiments. "First", "second", "third" and the like describe a common object and indicate different instances of like objects are being referred to. Such adjectives do not imply objects so described must be in a given sequence, either temporally, spatially, in ranking, or in any other manner. "Connected" may indicate elements are in direct physical or electrical contact with each other and "coupled" may indicate elements co-operate or interact with each other, but they may or may not be in direct physical or electrical contact.

An embodiment includes a produce bag having one side wall of a cross laminated synthetic resin fabric mesh material. The mesh material forms a rear wall of the bag when a group of the bags are placed on wicket pins of the equipment for receiving produce. The mesh provides ventilation to contents, such as produce. The front or forward wall is of a synthetic multi-layer resin film. A lip of synthetic multi-layer resin film is formed along the upper portion of the mesh material wall of the bag where spaced holes for wicket pin attachment are formed. The lip extends below the forward wall into the interior of the bag space formed between the front and rear walls. The bag provides a flat stand-up bottom with triangular pleats that are heat sealed with excess material removed to form the bottom corners. As used herein, a pleat includes a fold in material made by doubling or otherwise layering the material upon itself and then pressing or stitching or otherwise sealing it into place.

An embodiment includes a bag comprising one side including a mesh substrate and another side including a solid film (e.g., polyethylene (PE), polypropylene, and the like) to be used on automatic packing equipment. The bottom of the bag is designed to function like flat bottom bags but with the added ventilation of a Fox Fresh-Mesh® Combo bag. In an embodiment the mesh wall can go to the back (nearer produce loading machine) but in another embodiment the mesh wall can to the front. Wicket holes may be included in a lip above the mesh wall or on an upper area of the solid film wall.

Figure 1:
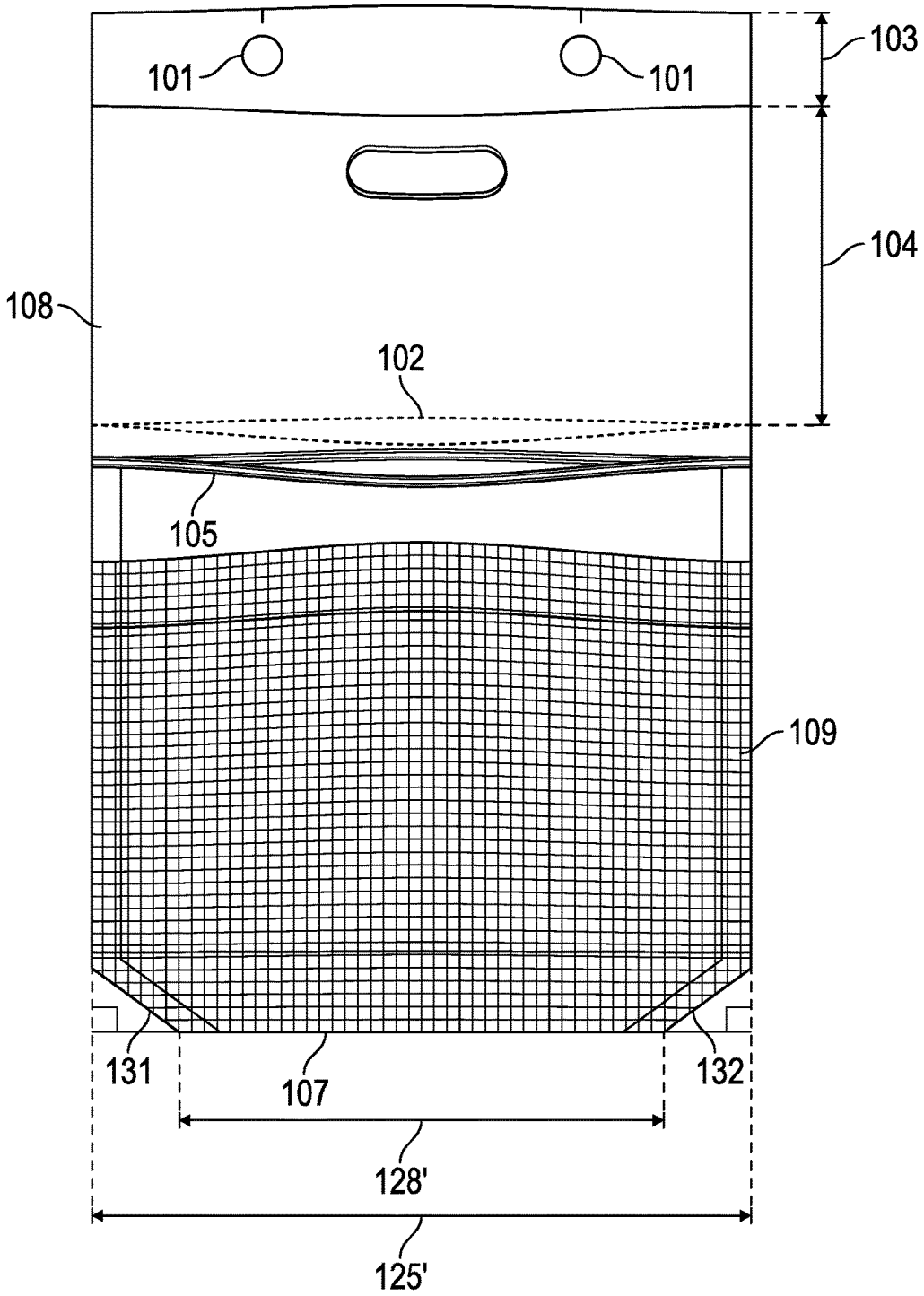
FIG. 1 includes a front view of a food package in an embodiment of the invention.
Figure 2:
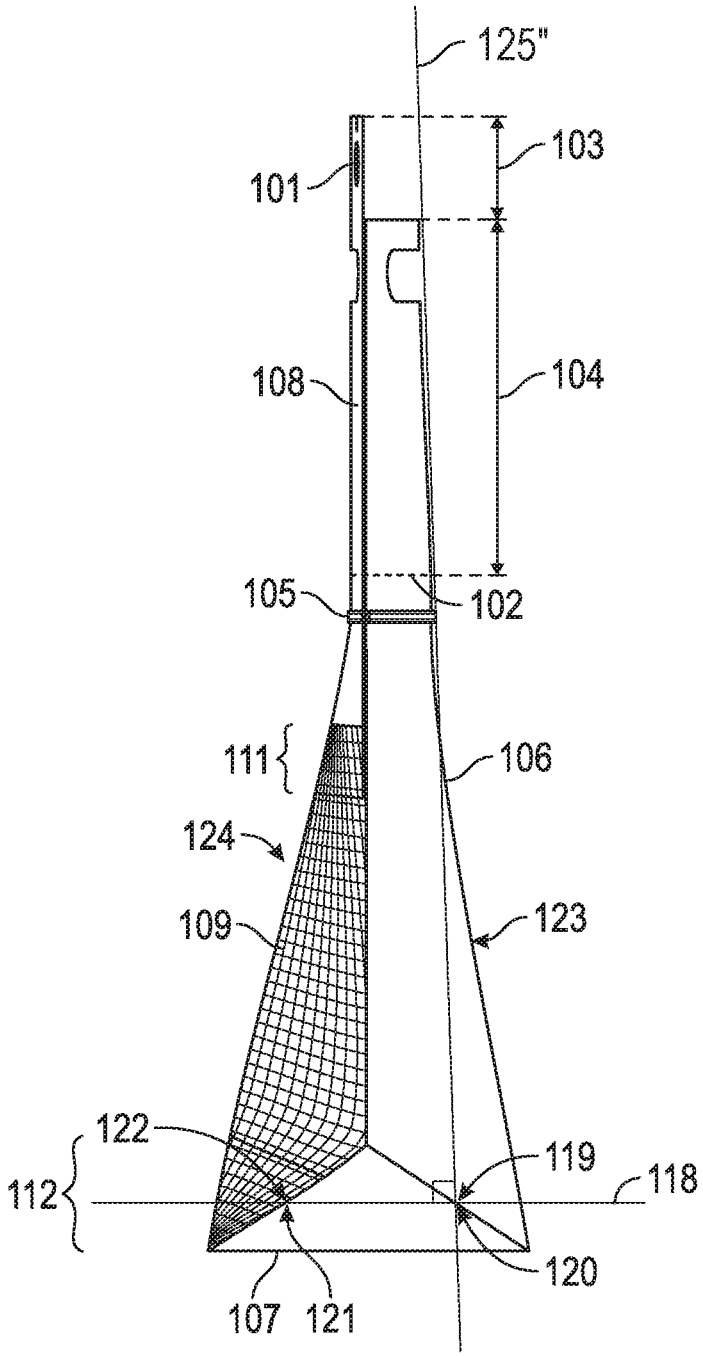
FIG. 2 includes a side view of a food package in an embodiment of the invention.
Figure 3:
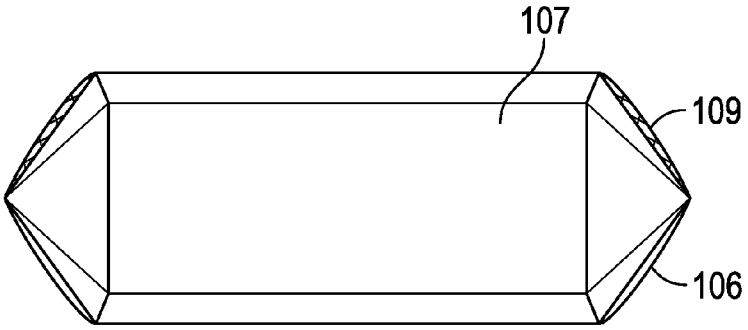
FIG. 3 includes a bottom view of a food package in an embodiment of the invention.
Figure 4:
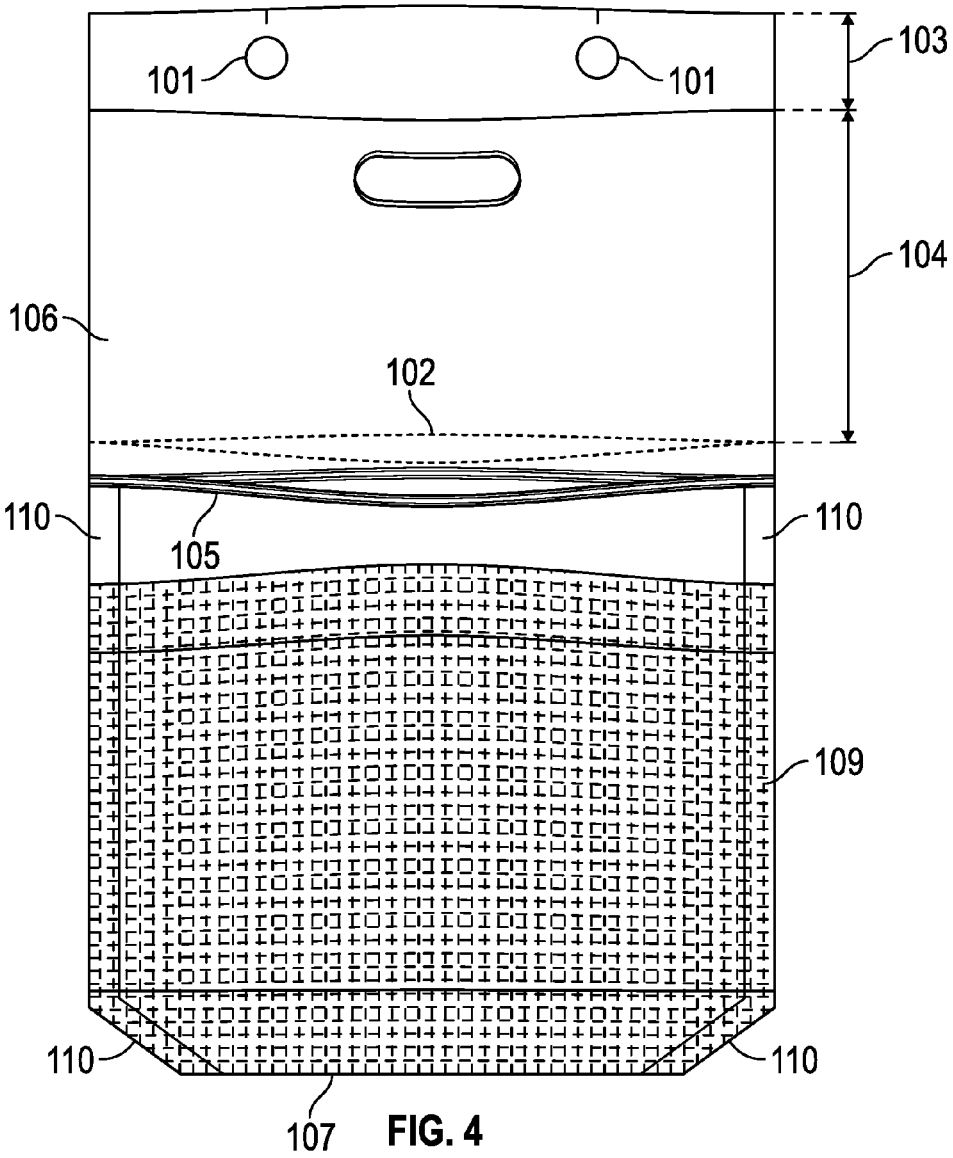
FIG. 4 includes a back view of a food package in an embodiment of the invention.
Figure 5:
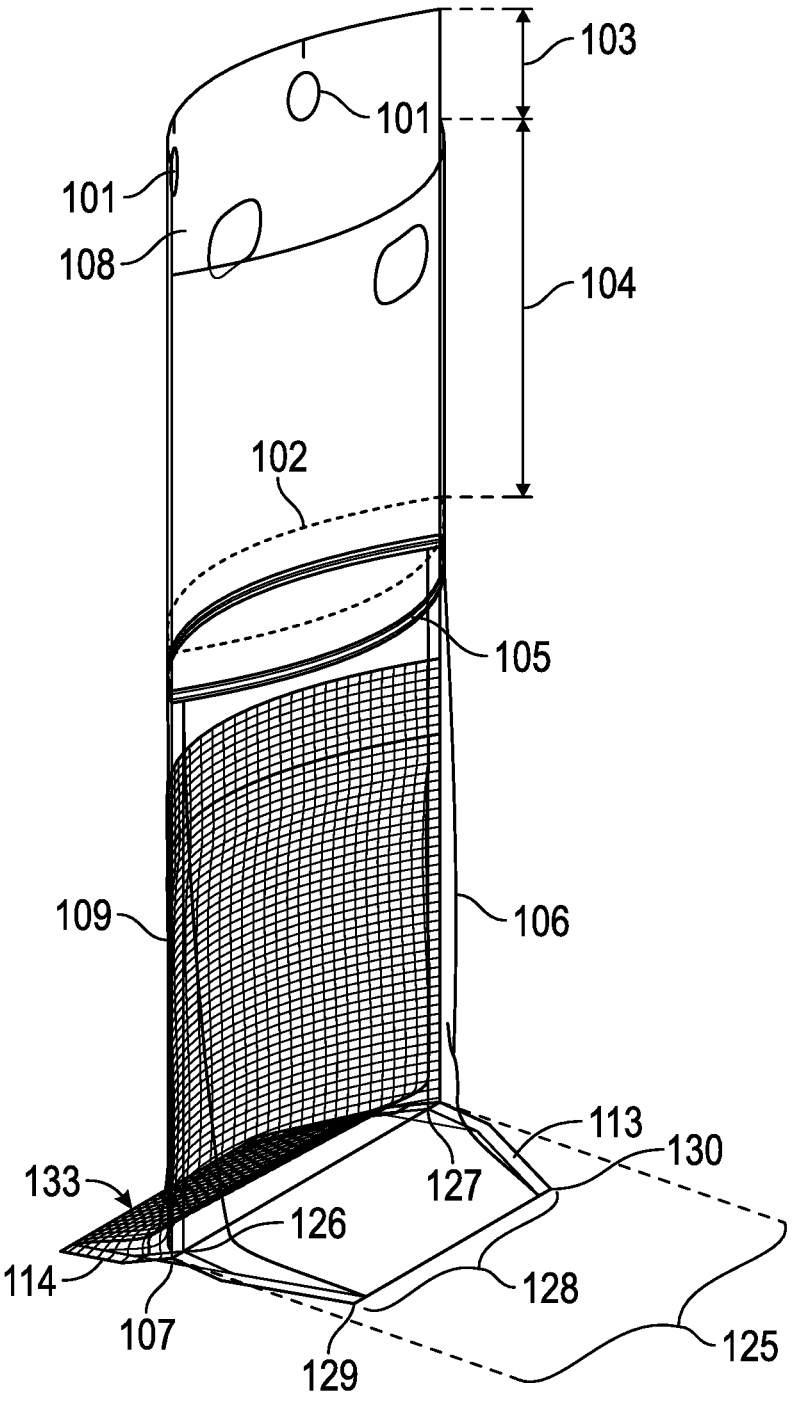
FIG. 5 includes a perspective view of a food package in an embodiment of the invention.

FIGS. 1-6 address an embodiment now described collectively. FIG. 1 includes a food package in an embodiment of the invention. FIG. 1 shows a synthetic resin bag for use with wicket pins of automatic bag filling equipment, comprising: first and second side walls; the first side wall 109 being formed from a synthetic resin fiber mesh material (sometimes referred to herein as the "mesh side wall" in FIG. 1) and the second side wall 106 being formed of a synthetic resin film (sometimes referred to herein as the "film side wall" in FIG. 1); the vertical side walls of the first and second sidewall being sealed to one another (e.g., heat sealed using a thin seal, lap seal, and the like) along areas 110 of the perimeter of the bag; a reinforcing strip of synthetic resin film 108 extending along an upper edge of the synthetic resin fiber mesh side wall 109; the reinforcing strip being joined at a laterally extending seam 111 across the upper edge of the synthetic resin fiber mesh side wall; the synthetic resin film side wall having a downward extension 107 which is folded upwardly to lap over and enclose a lower portion 112 of the synthetic resin fiber mesh side wall, the upwardly folded overlapping portion of the synthetic resin film side wall being secured to the mesh in the synthetic resin fiber mesh side wall; the upwardly folded, overlapping portion of the synthetic resin film side wall being joined along vertical side edges to the side walls (i.e., both a lower portion of the film side wall and a lower portion of the mesh side wall) along their vertical extent 110 (e.g., see portion 113 for where the upwardly folded overlapping portion of the synthetic resin film side wall overlaps a lower portion of the film side wall and see portion 114 for where the upwardly folded overlapping portion of the synthetic resin film side wall overlaps a lower portion of the mesh side wall); the reinforcing strip having one or more holes 101 formed therein for mounting the bag on the wicket pin or pins of the bag filling equipment.

Figure 7:
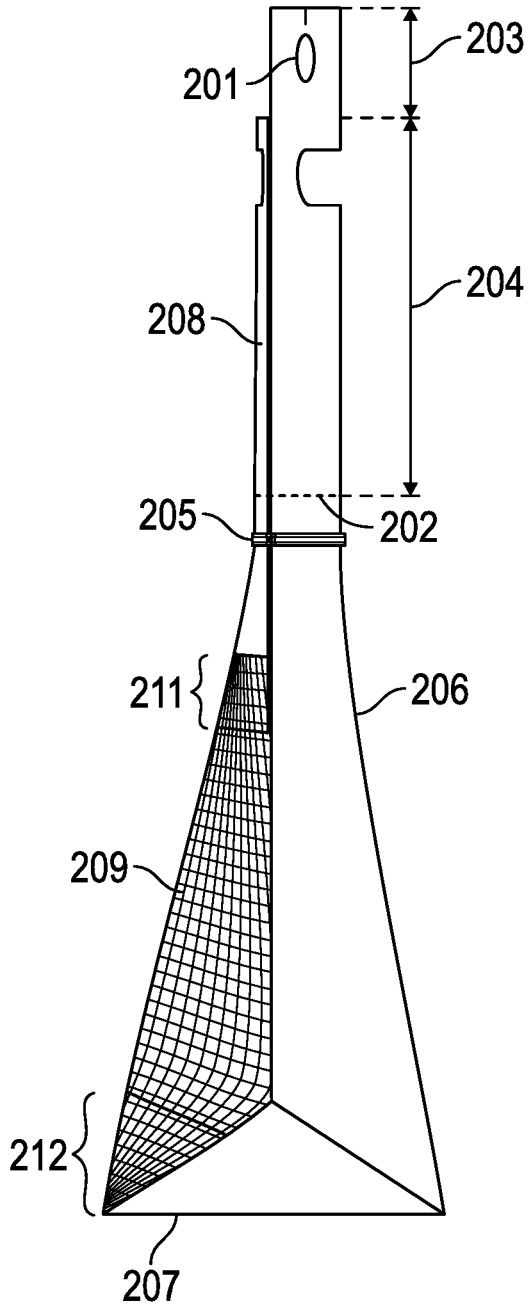
FIG. 7 includes a front view of a food package in an embodiment of the invention.
Figure 8:
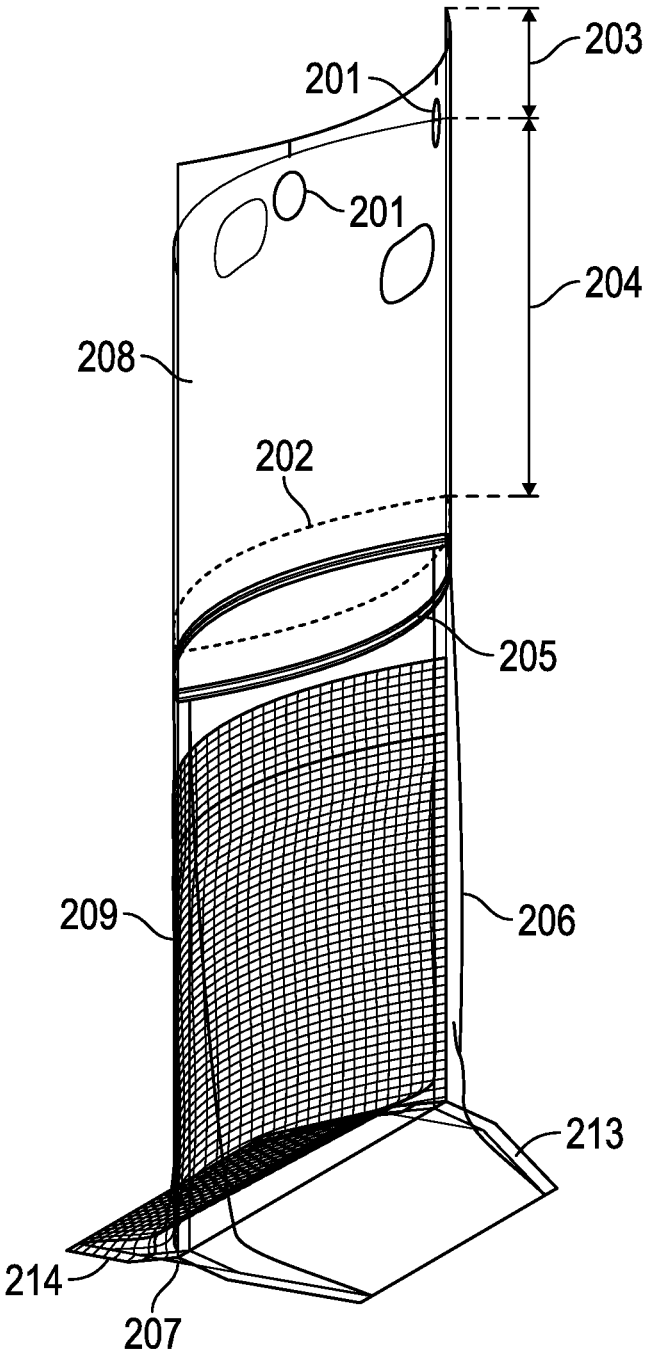
FIG. 8 includes a perspective view of a food package in an embodiment of the invention.
Figure 9:
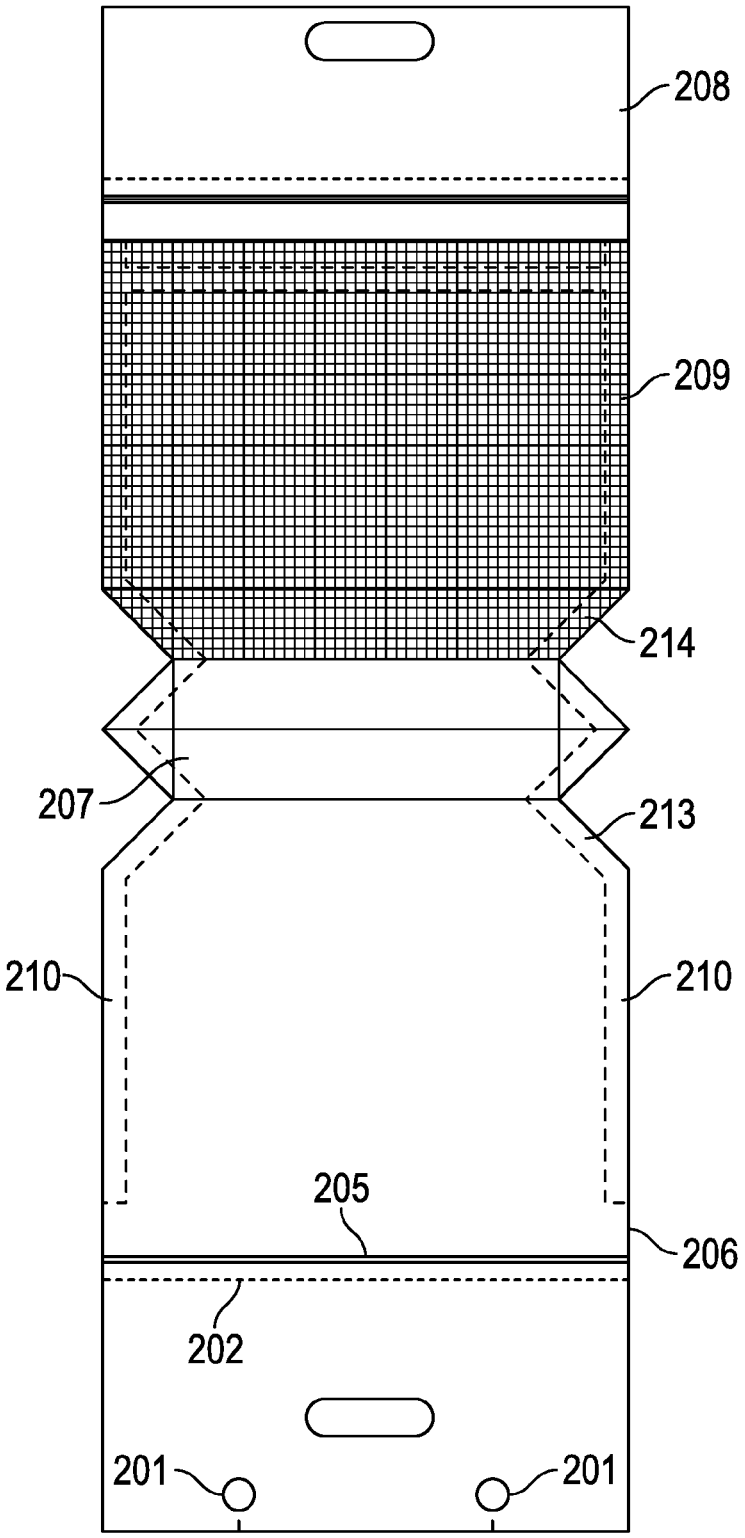
FIG. 9 includes a deconstructed view of a food package in an embodiment of the invention.

FIGS. 7-9 address an embodiment now described collectively. A second embodiment includes a synthetic resin bag for use with wicket pins of automatic bag filling equipment, comprising: first and second side walls; the first side wall 209 being formed from a synthetic resin fiber mesh material (referred to as the "mesh side wall") and the second side wall 206 being formed of a synthetic resin film (referred to as the "film side wall"); the vertical side walls of the first and second sidewall being sealed to one another (e.g., heat sealed) 210; a reinforcing strip of synthetic resin film 108 extending along an upper edge of the synthetic resin fiber mesh side wall; the reinforcing strip being joined at a laterally extending seam 211 across the upper edge of the synthetic resin fiber mesh side wall; the synthetic resin film side wall having a downward extension 207 which is folded upwardly to lap over and enclose a lower portion 212 of the synthetic resin fiber mesh side wall, the upwardly folded overlapping portion of the synthetic resin film side wall being secured to the mesh in the synthetic resin fiber mesh side wall; the upwardly folded, overlapping portion of the synthetic resin film side wall being joined along vertical side edges to the side walls along their vertical extent (e.g., see portion 213 for where the upwardly folded overlapping portion of the synthetic resin film side wall overlaps a lower portion of the film side wall and see portion 214 for where the upwardly folded overlapping portion of the synthetic resin film side wall overlaps a lower portion of the mesh side wall); the upper portion of the second side wall having one or more holes 201 formed therein for mounting the bag on the wicket pin or pins of the bag filling equipment.

Thus, in the second embodiment the wicket hole or holes 201 may be included on a different portion of the bag system than in the first embodiment 101. In some embodiments there are no such wicket hole or holes in any portion of the system. In such a case either or both of the reinforcement strip 108, 208 and film sidewall 106, 206 may be shortened because there is no need for an extension through which a wicket hole or holes are formed (i.e., portion 103, 203 may be omitted). Various meshes, both open and closed and/or woven or unwoven, may be used in various embodiments.

Figure 11:
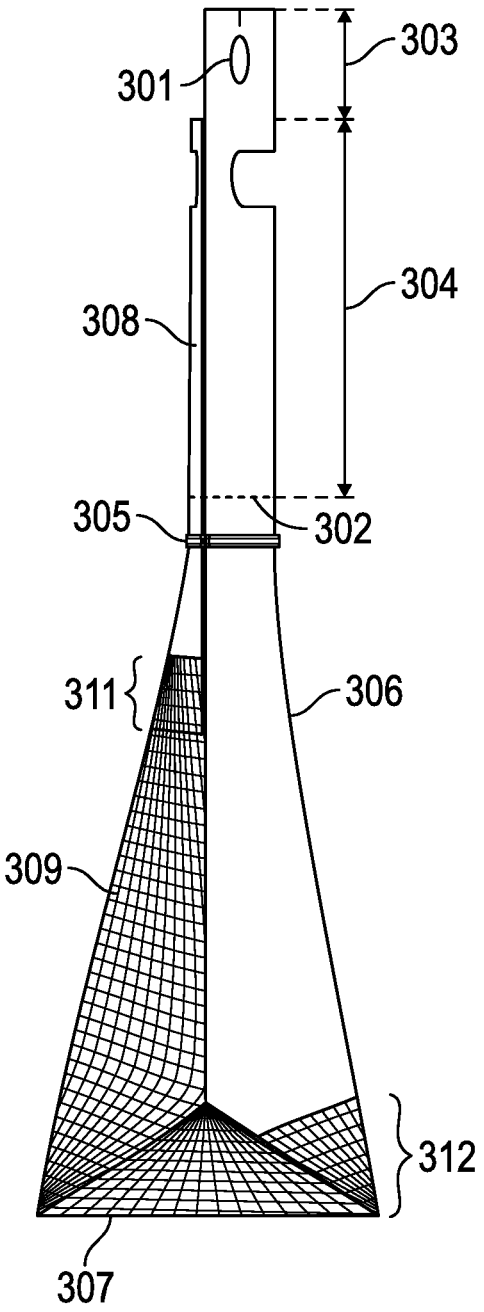
FIG. 11 includes a side view of a food package in an embodiment of the invention.
Figure 12:
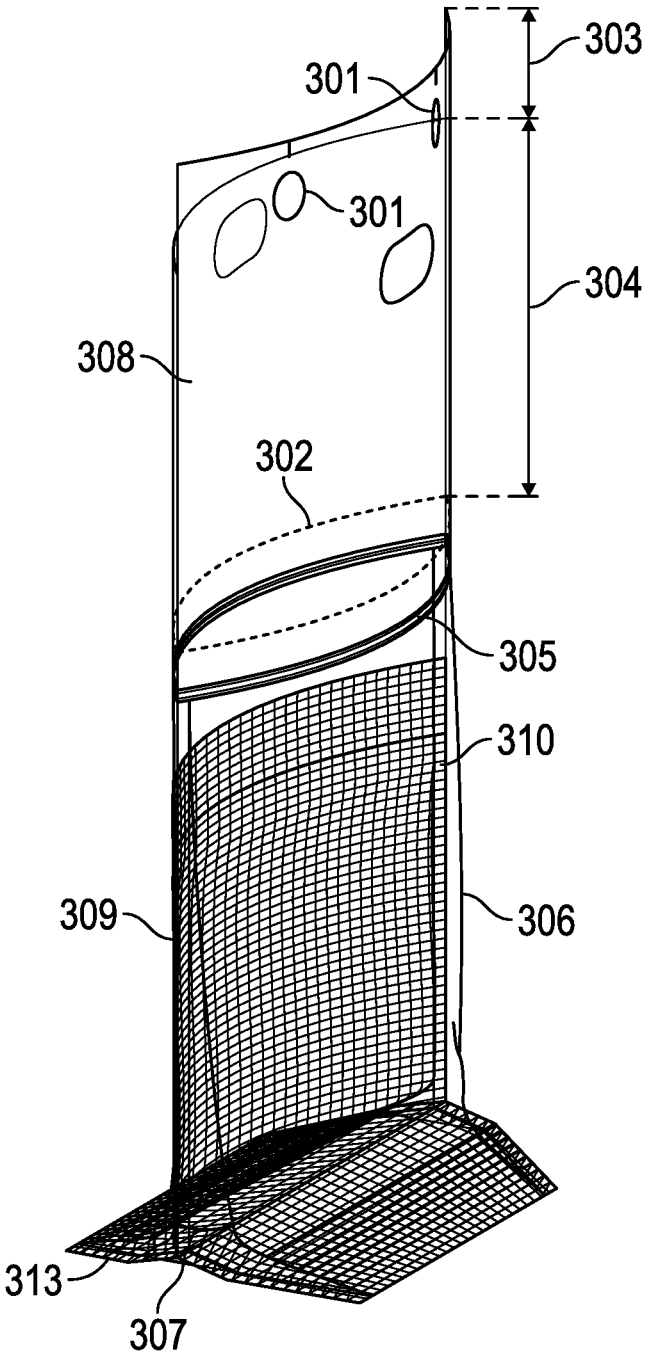
FIG. 12 includes a perspective view of a food package in an embodiment of the invention.

FIGS. 11-12 address an embodiment now described collectively. A third embodiment includes a synthetic resin bag for use with wicket pins of automatic bag filling equipment, comprising: first and second side walls; the first side wall 309 being formed from a synthetic resin fiber mesh material (referred to as the "mesh side wall") and the second side wall 306 being formed of a synthetic resin film (referred to as the "film side wall"); the vertical side walls of the first and second sidewall being sealed to one another (e.g., heat sealed); a reinforcing strip of synthetic resin film 308 extending along an upper edge of the synthetic resin fiber mesh side wall; the reinforcing strip being joined at a laterally extending seam 311 across the upper edge of the synthetic resin fiber mesh side wall; the first side wall (mesh) having a downward extension 307 which is folded upwardly to lap over a lower portion of the second side wall (film), the upwardly folded overlapping portion 312 of the mesh wall being secured to the film; the upwardly folded, overlapping portion of the mesh side wall being joined along vertical side edges to the side walls along their vertical extent 310; the upper portion of the second side wall (film) having holes 301 formed therein for mounting the bag on the wicket pins of the bag filling equipment.

Thus, in the third embodiment at least a portion of the bottom of the bag 307 may include mesh. In an embodiment a strip of film may be added along some or all the lateral edges of the mesh. For example, a strip of film may be added along the lateral walls of mesh that will form the bottom of the bag. For example, in FIG. 12 the film could be added along portion 313. This addition of film may provide greater surface area for the mesh to bond to and may be positioned so that after the mesh is folded upon itself to make the pleated bottom the film is between the two opposing mesh portions thereby providing each mesh portion adequate real estate with which to bond.

A fourth embodiment is very similar to the embodiment of FIG. 11 only the wicket holes are included in reinforcement film 308 instead of or in addition to wall 306. The fourth embodiment includes a synthetic resin bag for use with wicket pins of automatic bag filling equipment, comprising: first and second side walls; the first side wall being formed from a synthetic resin fiber mesh material (referred to as the "mesh side wall" in FIG. 1) and the second side wall being formed of a synthetic resin film (referred to as the "film side wall" in FIG. 1); the vertical side walls of the first and second sidewall being sealed to one another (e.g., heat sealed); a reinforcing strip of synthetic resin film (element 108 in FIG. 1) extending along an upper edge of the synthetic resin fiber mesh side wall; the reinforcing strip being joined at a laterally extending seam across the upper edge of the synthetic resin fiber mesh side wall; the first side wall (mesh) having a downward extension which is folded upwardly to lap over and enclose a lower portion of the second side wall (film), the upwardly folded overlapping portion of the mesh wall being secured to the film; the upwardly folded, overlapping portion of the mesh side wall being joined along vertical side edges to the side walls along their vertical extent (not shown); the reinforcing strip having holes (element 101) formed therein for mounting the bag on the wicket pins of the bag filling equipment.

Figure 6:
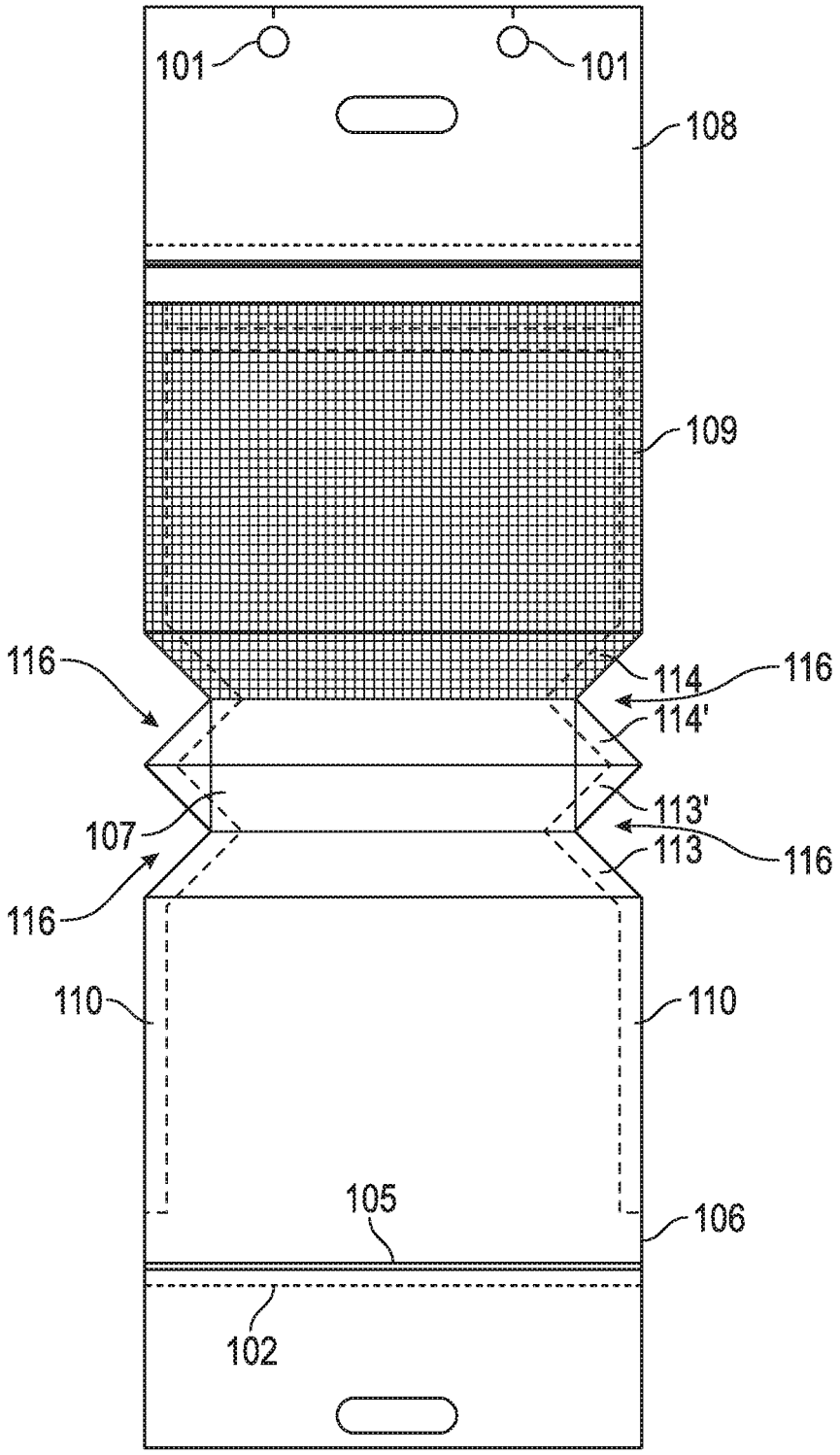
FIG. 6 includes a deconstructed view of a food package in an embodiment of the invention.

Any of the first, second, third, and fourth embodiments may include a flat stand-up bottom with triangular pleats (e.g., element 114) that are heat sealed with excess material removed to form the bottom corners. The flat bottom may still allow for a "J fold" extension (because the upwardly folded overlapping portion of the film wall looks like a "J") that has extended monolithically from the film side wall 106, to form the bottom 107, and then upwards to overlay the mesh side wall at portion 112, and which has areas 113, 113', 114, 114' where the J fold extension has been folded and heat sealed upon itself to make the triangular pleats and, consequently, the flat stand up bottom). FIG. 6 shows a "deconstructed embodiment" that shows how a film sidewall having triangular gussets/portions 116 removed can be folded upon itself to make the standup bag bottom.

Figure 10:
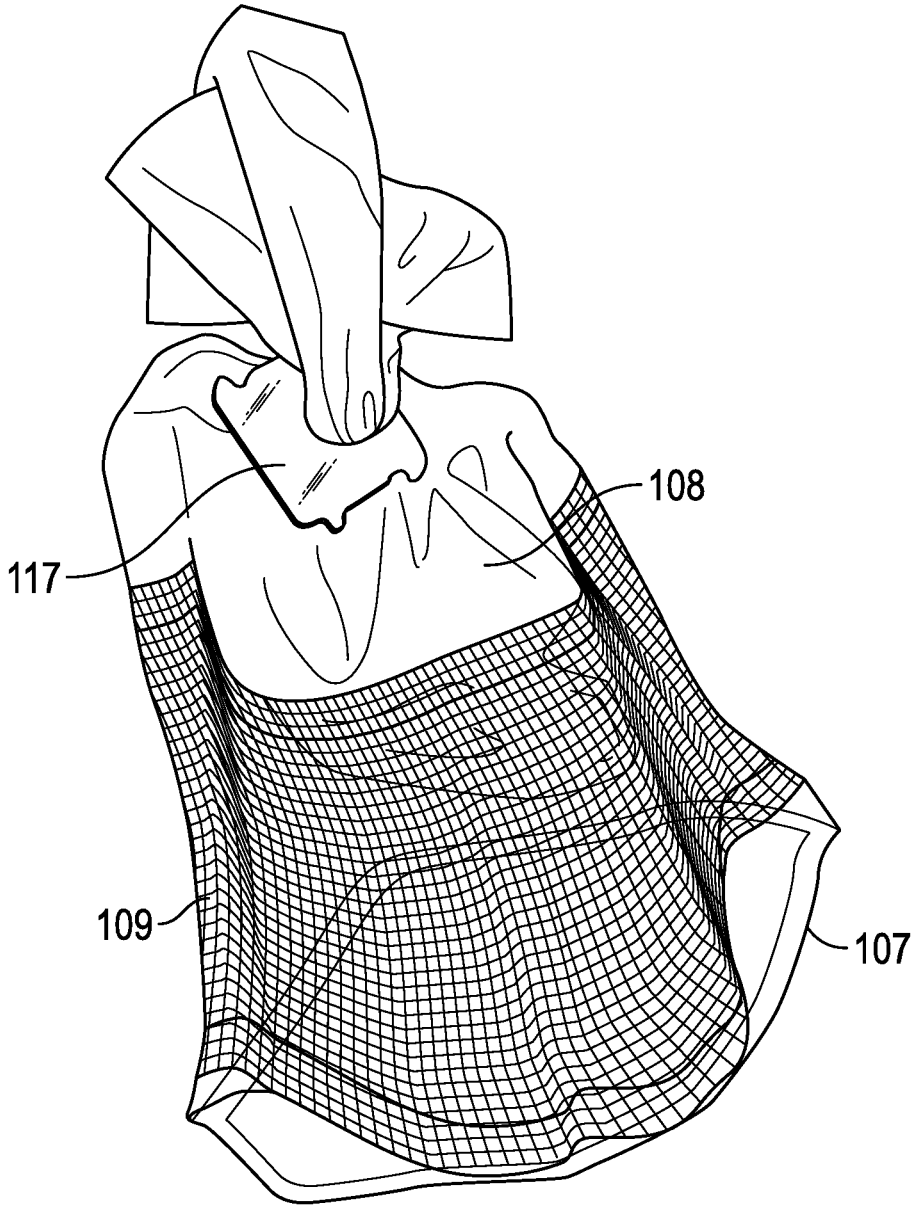
FIG. 10 includes a perspective view of a food package in an embodiment of the invention.

FIG. 10 includes (but does not show a zipper closing mechanism similar to mechanism 105) that is not closed and a clip 117 that has clipped the top of the reinforcement strip (that is on top of the mesh) to the film sidewall. The zipper mechanism is also depicted at 105 of FIG. 1 (and at analogous elements 205, 305). For brevity, every time an element such as element 105 is addressed analogous elements 205, 305 may not be directly addressed. Of course other embodiments may include no closing mechanism, a hook and loop closing system, or other closing systems (e.g., draw string) known in the art. Returning to FIG. 10, the embodiment of FIG. 10 provides an advantage because in an embodiment the bag may be filled with a machine and without requiring a human to close the bag. For example, a human may be needed to close the zipper closing mechanism after the bag is filled with toys, produce, and the like. However, a filling machine can easily apply the clip 117 to the bag in a manner commonly employed with, for example, sealing a bag of bread on an assembly line. A consumer may purchase the bag, filled with fruit, with only the clip 117 fastened but the zipper closing mechanism not fastened or closed. The consumer may then remove the upper portion of reinforcement strip and/or upper film sidewall along the perforation line (see FIG. 1 element 102 for an example of a perforation). The consumer may then use the zipper closure mechanism (see FIG. 1 element 105 for an example of a perforation). Thus, the consumer gets the convenience of a zipper fastener while the product may still be efficiently loaded using a closure mechanism (e.g., clip 117) that may be attached by a machine.

Not all embodiments require a mesh. For example, in other embodiments another breathable material may be substituted for the mesh (such as a film having a high oxygen transmission rate (OTR).

While "reinforcement strip" is used herein the strip is not necessarily for strength but may provide a platform to which suction cups may couple and retract thereby opening the bag for the introduction of product (e.g., toys).

The embodiment of FIG. 1 shows mesh sidewall 109 extending to the bottom 107 such that overlapping portion 112 is directly adjacent bottom/extension 107. However, in other embodiment area 112 may be moved upwards an inch or more for embodiment that may not require as much ventilation and may wish to conserve money by limiting mesh as much as possible.

While not illustrated, an embodiment may include a draw-string closure to seal the top of the container. Another embodiment may include loop handles sealed (e.g., heat seal) to the top of the film side wall or reinforcing strip.

Thus, an embodiment includes a unique combination of features that provide advantages to packing industries. For example, an embodiment such as the embodiment of FIG. 1 includes (a) wicket holes so the bags can be operated with many article loading devices that include wickets, (b) a mesh side wall that allows for ventilation, which can lengthen shelf life for certain products, and (c) a bottom that is flat or at least includes a flat portion so the bag can stand up and present nicely on store shelves and in the home.

At times herein an embodiment may include a seam that is heat sealed. However, in other embodiments those same seams may be sealed using alternative methods. Methods for sealing seams may use, without limitation, hot bar sealers (e.g., uses heated tooling kept at a constant temperature, also known as Direct Contact Thermal Sealing, and may use one or more heated bars, irons, or dies to contact the material to heat the interface and form a bond), continuous heat sealers (e.g., also known as Band type heat sealers that utilize moving belts over heating elements), impulse heat sealers (e.g., having heating elements (e.g., one, two, or more) placed between a resilient synthetic rubber and a release surface of film or fabric where heating elements are not continuously heated and heat is generated only when current flows such that an electric current heats the heating element for a specified time to create the required temperature), hot melt adhesive (e.g., applied in strips or beads at the point of joining and can also be applied to one of the surfaces during an earlier manufacturing step and reactivated for bonding), hot wire sealing (e.g., involves a heated wire that both cuts the surfaces and joins them with a molten edge bead, induction sealing (e.g., a non-contact type of sealing), ultrasonic welding (e.g., uses high-frequency ultrasonic acoustic vibrations to work pieces being held together under pressure to create a junction), and the like.

At times herein a bag or container may be said to include a wicket hole to receive one more wickets. An embodiment may provide a single wicket hole that is large enough to accommodate two or more wickets. In an embodiment such a hole may be torn when the user removes the bag from the wickets or may be preserved if the user slides the bag off of the wickets. If the hole is preserved the hole may be large enough to function as a handle for the bag for the user to slide her or her fingers through the hole.

The following examples pertain to further embodiments.

Example 1 includes a bag comprising: a mesh side wall, a film side wall, and a reinforcing strip of film; wherein (a) the mesh side wall is directly sealed to opposing side edges of the film side wall; (b) the reinforcing strip of film is directly sealed to an upper portion of the mesh side wall and to the opposing side edges of the film side wall; (c) the film side wall has a bottom extension, which is monolithic with the film side wall, extending upwardly and directly sealed along a lateral extent of a bottom portion of the mesh side wall; (d) the film side wall is non-coplanar with a portion of the bottom extension; (e) another portion of the bottom extension is non-coplanar with the mesh side wall; (f) a horizontal axis intersects the bottom portion of the film side wall and three portions of the bottom extension; (g) the horizontal axis is orthogonal to a plane including the film side wall; and (h) the bottom extension includes first, second, and third lateral portions, the first and second lateral portions are directly sealed to each other but not to the third lateral portion, and the third lateral portion directly seals to the bottom portion of the film side wall.

As used herein, "monolithic" means formed or composed of material without joints or seams. Some embodiments do not require that the bottom extension be monolithic with the film side wall. As mentioned above, in example the film side wall is non-coplanar with a portion of the bottom extension, such as portions 123 (of wall 106) and 120 (rising portion of extension 107). As mentioned above, in the example another portion of the bottom extension 121 is non-coplanar with the mesh side wall 124. As mentioned above, a horizontal axis, such as axis 118, intersects the bottom portion of the film side wall at location 119 and three portions of the bottom extension 120, 121, 122. In an embodiment the horizontal axis 118 is orthogonal to a plane 125" including a portion of the film side wall. In an embodiment the bottom extension 107 includes first, second, and third lateral portions, the first and second lateral portions 121, 122 are directly sealed to each other but not to the third lateral portion, and the third lateral portion 120 directly seals to the bottom portion 119 of the film side wall.

In example 2 the subject matter of the Example 1 can optionally include wherein the reinforcing strip includes a least one hole configured to receive at least one wicket pin of a bag filling apparatus. The at least one hole may include 1, 2, 3 or more holes.

In example 3 the subject matter of the Examples 1-2 can optionally include wherein an uppermost portion of the reinforcing strip extends higher than an uppermost portion of the film side wall. Such an uppermost portion may include portion 103.

In example 4 the subject matter of the Examples 1-3 can optionally include wherein the film side wall includes a least one hole configured to receive at least one wicket pin of a bag filling apparatus.

In example 5 the subject matter of the Examples 1-4 can optionally include wherein an uppermost portion of the film side wall extends higher than an uppermost portion of the reinforcing strip.

In example 6 the subject matter of the Examples 1-5 can optionally include wherein the bottom extension includes a fourth lateral portion directly sealed to the bottom portion of the mesh side wall. Such a location may also be location 121 where a lateral portion of the extension seals to another portion of the extension and to a portion of the mesh side wall.

In example 7 the subject matter of the Examples 1-6 can optionally include wherein the bottom extension includes additional first, second, and third lateral portions respectively opposite the first, second, and third later portions, the additional first and second lateral portions are directly sealed to each other, and the additional third later portion directly seals to the bottom portion of the film side wall.

In example 8 the subject matter of the Examples 1-7 can optionally include wherein the bottom extension includes an additional fourth lateral portion, opposite the fourth lateral portion, directly sealed to the bottom portion of the mesh side wall.

In example 9 the subject matter of the Examples 1-8 can optionally include wherein the horizontal axis intersects a bottom portion of the mesh side wall. This may occur at, for example, location 122.

In example 10 the subject matter of the Examples 1-9 can optionally include wherein the bottom extension is folded downwardly along a lateral extent of the bottom extension. The lateral extent may include location 125, which extends between ends 126, 127.

In example 11 the subject matter of the Examples 1-10 can optionally include wherein the bottom extension is folded downwardly along a lateral extent of the bottom extension and is folded upwardly along an additional lateral extent of the bottom extension. The additional lateral extent may include portion 128 which may extent between ends 129, 130.

In example 12 the subject matter of the Examples 1-11 can optionally include wherein the lateral extent has a maximum width and the additional lateral extent has an additional maximum width, and the maximum width is wider than the additional maximum width. For example, width 125' is wider than width 128' due to angle indentions 116. Breadths or widths 125', 128' of FIG. 1 help illustrate the issue.

In example 13 the subject matter of the Examples 1-12 can optionally include wherein the reinforcing strip and the side film wall each include a synthetic resin film and the mesh side wall includes a synthetic resin fiber mesh.

In example 14 the subject matter of the Examples 1-13 can optionally include a first pleated seal including a first lateral portion of the bottom extension and a first lateral portion of the film side wall; and a second pleated seal including a second lateral portion of the bottom extension and a second lateral portion of the film side wall; wherein the first pleated seal includes monolithic material folded upon itself.

In example 15 the subject matter of the Examples 1-14 can optionally include wherein the bag includes a third pleated seal including a third lateral portion of the bottom extension and a first lateral portion of the mesh side.

In example 16 the subject matter of the Examples 1-15 can optionally include wherein the mesh side wall being directly sealed to the opposing side edges of the film side wall includes the mesh side wall being directly and fixedly sealed to opposing side edges of the film side wall via a heat seal.

In example 17 the subject matter of the Examples 1-16 can optionally include wherein the film side wall includes a bottom edge orthogonal to the side edges of the film side wall, and the bottom edge couples to the orthogonal edge via an angled edge that is not orthogonal with either the bottom edge or the side edges of the film side wall. Such a bottom edge 128 couples to side walls via angled edges 131, 132.

In example 18 the subject matter of the Examples 1-17 can optionally include wherein (i) the film side wall includes a bottommost edge that directly contacts the bottom extension, (j) the bottom extension includes an additional bottommost edge not directly connected to the opposing side edges of the film side wall and not directly connected to the film side wall, and (k) the bottommost edge and the additional bottommost edge are generally equidistant to a topmost portion of the reinforcing strip.

In example 19 the subject matter of the Examples 1-18 can optionally include wherein (i) the film side wall includes a bottommost edge that directly contacts the bottom extension, (j) the bottom extension includes an additional bottommost edge not directly connected to the opposing side edges of the film side wall and not directly connected to the film side wall, and (k) the bottommost edge and the additional bottommost edge each include lateral-most edges that pivot freely from one another. For example, portions 128, 133 may pivot freely of one another.

In example 20 the subject matter of the Examples 1-19 can optionally include_wherein the bottom extension forms a non-gusseted bottom of the bag. A gusseted bottom Example 21 may include a bag comprising: a mesh side wall, a film side wall, and a reinforcing strip of film; wherein (a) the mesh side wall is directly sealed to opposing side edges of the film side wall; (b) the reinforcing strip of film is directly sealed to an upper portion of the mesh side wall and to the opposing side edges of the film side wall; (c) the film side wall has a bottom extension, which is monolithic with the film side wall, extending upwardly and directly sealed along a lateral extent of a bottom portion of the mesh side wall; (d) a horizontal axis intersects the bottom portion of the film side wall and three portions of the bottom extension; and (e) the film side wall includes a bottom edge orthogonal to the side edges of the film side wall, and the bottom edge couples to the side edges of the film side wall via angled edges that are not orthogonal with either the bottom edge or the side edges of the film side wall.

In example 22 the subject matter of Example 21 can optionally include wherein the bottom extension is folded downwardly along a lateral extent of the bottom extension and is folded upwardly along an additional lateral extent of the bottom extension.

In example 23 the subject matter of the Examples 21-22 can optionally include wherein the lateral extent has a maximum width and the additional lateral extent has an additional maximum width, and the maximum width is wider than the additional maximum width.

In example 24 the subject matter of the Examples 21-23 can optionally include a first pleated seal including a first lateral portion of the bottom extension and a first lateral portion of the film side wall; and a second pleated seal including a second lateral portion of the bottom extension and a second lateral portion of the film side wall; wherein the first pleated seal includes monolithic material folded upon itself.

In example 25 the subject matter of the Examples 21-24 can optionally include wherein (f) the film side wall includes a bottommost edge that directly contacts the bottom extension, (g) the bottom extension includes an additional bottommost edge not directly connected to the opposing side edges of the film side wall and not directly connected to the film side wall, and (h) the bottommost edge and the additional bottommost edge each include lateral-most edges that pivot freely from one another.

In example 26 a bag comprises: a mesh side wall, a film side wall, and a reinforcing strip of film; wherein (a) the mesh side wall is directly sealed to opposing side edges of the film side wall; (b) the reinforcing strip of film is directly sealed to an upper portion of the mesh side wall and to the opposing side edges of the film side wall; (c) the mesh side wall has a bottom extension, which is monolithic with the mesh side wall, extending upwardly and directly sealed along a lateral extent of a bottom portion of the film side wall; (d) a horizontal axis intersects the bottom portion of the mesh side wall and three portions of the bottom extension; and (e) the mesh side wall includes a bottom edge orthogonal to the side edges of the mesh side wall, and the bottom edge couples to the side edges of the mesh side wall via angled edges that are not orthogonal with either the bottom edge or the side edges of the mesh side wall.

In example 27 the subject matter of the Example 26 can optionally include wherein the bottom extension is folded downwardly along a lateral extent of the bottom extension and is folded upwardly along an additional lateral extent of the bottom extension and further wherein the lateral extent has a maximum width and the additional lateral extent has an additional maximum width, and the maximum width is wider than the additional maximum width.

In example 28 the subject matter of the Examples 1-20 can optionally include wherein a bottommost edge of the bag is narrower than a middle portion of the bag, the middle portion of the bag being located near a middle location equidistant from a top and the bottom of the bag.

Thus, an embodiment provides unique advantages over conventional packaging systems. For example, conventional bags with flat bottoms need to be packed by hand because they do not have the length or height above the closure mechanism (e.g., zip lock) to provide a panel for suction means (e.g., suction cup or cups coupled to a negative pressure source) to adhere to the panel and open the bag for loading. Further there is not enough space on such a panel or opposing panel thereto in which to form wicket holes that mount on wickets. In contrast, embodiments described herein provide a bag suitable for a wicketed system (i.e. having one or more wicket holes) in combination with a flat stand-up bottom that can be loaded using a conventional automated wicket based loader such as the Fox Solutions FS-WB 1 wicket based loader. Certainly no combination of a wicketed system, with a flat pleated stand-up bottom, with a mesh wall (not just a mesh window or insert) and possibly a mesh bottom has ever been found in the packaging art. Thus embodiments truly provide distinct advantages over the prior art. For example, the prior art fails to disclose an embodiment such as the embodiment of FIG. 10 that has wicket holes for auto loading, a closure 117 for auto closing, a zipper or gliding closure for additional closure such as item 305, a mesh wall, a film side wall, a flat bottom, and a perforation (e.g., 302) so the wicket holes and excess film wall (needed for auto loading) can be removed after loading. Of course various embodiments include some or all of these elements such that, for example, perforation and/or wicket holes and/or slide closure and/or kwik loc mechanisms may be omitted along with other aforementioned elements in some embodiments.

The foregoing description of the embodiments of the invention has been presented for the purposes of illustration and description. It is not intended to be exhaustive or to limit the invention to the precise forms disclosed. This description and the claims following include terms, such as left, right, top, bottom, over, under, upper, lower, first, second, etc. that are used for descriptive purposes only and are not to be construed as limiting. The embodiments of a device or article described herein can be manufactured, used, or shipped in a number of positions and orientations. Persons skilled in the relevant art can appreciate that many modifications and variations are possible in light of the above teaching. Persons skilled in the art will recognize various equivalent combinations and substitutions for various components shown in the Figures. It is therefore intended that the scope of the invention be limited not by this detailed description, but rather by the claims appended hereto.

What is claimed is:

1. A bag comprising:

a mesh side wall, a film side wall, and a reinforcing strip of film;

wherein (a) the mesh side wall is directly sealed to opposing side edges of the film side wall; (b) the reinforcing strip of film is directly sealed to an upper portion of the mesh side wall and to the opposing side edges of the film side wall; (c) the mesh side wall has a bottom extension, which is monolithic with the mesh side wall, extending upwardly and directly sealed along a lateral extent of a bottom portion of the film side wall; (d) a horizontal axis, orthogonal to a vertical axis that extends from a bottom of the bag to a top of the bag, intersects a bottom portion of the mesh side wall and three portions of the bottom extension; and (e) the mesh side wall includes a bottom edge orthogonal to side edges of the mesh side wall, and the bottom edge couples to the side edges of the mesh side wall via angled edges that are not orthogonal with either the bottom edge or the side edges of the mesh side wall.

2. The bag of claim 1, wherein the bottom extension is folded downwardly along a lateral extent of the bottom extension and is folded upwardly along an additional lateral extent of the bottom extension and further wherein the lateral extent has a maximum width and the additional lateral extent has an additional maximum width, and the maximum width is wider than the additional maximum width.

3. The bag of claim 1, wherein the reinforcing strip includes a least one hole configured to receive a user's fingers.

4. The bag of claim 3, wherein an uppermost portion of the reinforcing strip extends higher than an uppermost portion of the film side wall.

5. The bag of claim 3, wherein the film side wall includes a least one hole configured to receive a user's fingers.

6. The bag of claim 3, wherein an uppermost portion of the film side wall extends higher than an uppermost portion of the reinforcing strip.

7. The bag of claim 1, wherein the horizontal axis intersects a bottom portion of the film side wall.

8. The bag of claim 1, wherein the reinforcing strip and the film side wall each include a synthetic resin film and the mesh side wall includes a synthetic resin fiber mesh.

9. The bag of claim 1, wherein the mesh side wall being directly sealed to the opposing side edges of the film side wall includes the mesh side wall being directly and fixedly sealed to the opposing side edges of the film side wall via a heat seal.

10. A bag comprising: a mesh side wall, a film side wall, and a reinforcing strip of film; wherein (a) the mesh side wall is directly sealed to opposing side edges of the film side wall; (b) the reinforcing strip of film is directly sealed to an upper portion of the mesh side wall and to the opposing side edges of the film side wall; (c) the mesh side wall has a first portion of a bottom extension, which is monolithic with the mesh side wall, extending upwardly and directly sealed along a lateral extent of a bottom portion of the film side wall; (d) a horizontal axis, orthogonal to a vertical axis that extends from a bottom of the bag to a top of the bag, intersects a bottom portion of the mesh side wall and the first portion of the bottom extension and second and third portions of the bottom extension; and (e) the mesh side wall includes a bottom edge orthogonal to side edges of the mesh side wall, and the bottom edge couples to the side edges of the mesh side wall via angled edges that are not orthogonal with either the bottom edge or the side edges of the mesh side wall.

11. The bag of claim 10, wherein the bottom extension is folded downwardly along a lateral extent of the bottom extension and is folded upwardly along an additional lateral extent of the bottom extension and further wherein the lateral extent has a maximum width and the additional lateral extent has an additional maximum width, and the maximum width is wider than the additional maximum width.

12. The bag of claim 10, wherein the reinforcing strip includes a least one hole configured to receive a user's fingers.

13. The bag of claim 12, wherein an uppermost portion of the reinforcing strip extends higher than an uppermost portion of the film side wall.

14. The bag of claim 12, wherein the film side wall includes a least one hole configured to receive a user's fingers.

15. The bag of claim 14, wherein an uppermost portion of the film side wall extends higher than an uppermost portion of the reinforcing strip.

16. The bag of claim 1 wherein: the bottom extension is folded downwardly along a lateral extent of the bottom extension and is folded upwardly along an additional lateral extent of the bottom extension.

17. The bag of claim 10, wherein the reinforcing strip and the film side wall each include a synthetic resin film and the mesh side wall includes a synthetic resin fiber mesh.

18. The bag of claim 1 wherein:

the bottom extension is folded downwardly along a lateral extent of the bottom extension and is folded upwardly along an additional lateral extent of the bottom extension;

the mesh side wall generally lies within a first plane; and the horizontal axis is orthogonal to the first plane.

19. The bag of claim 16, wherein the horizontal axis intersects a bottom portion of the film side wall.

20. The bag of claim 1 wherein:

the bottom extension is folded downwardly along a lateral extent of the bottom extension and is folded upwardly along an additional lateral extent of the bottom extension.

* * * * *